US012486720B1

(12) United States Patent
Chamarthy et al.

(10) Patent No.: US 12,486,720 B1
(45) Date of Patent: Dec. 2, 2025

(54) MOTOR COOLING AND DEBRIS MANAGEMENT DURING MILLING

(71) Applicant: Halliburton Energy Services, Inc., Houston, TX (US)

(72) Inventors: Pramod Chamarthy, Carrollton, TX (US); Rodney Marlow, Houston, TX (US); Dezhi Zheng, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/983,918

(22) Filed: Dec. 17, 2024

(51) Int. Cl.

| | |
|---|---|
| ***E21B 4/02*** | (2006.01) |
| ***E21B 4/00*** | (2006.01) |
| *E21B 10/60* | (2006.01) |
| *E21B 12/04* | (2006.01) |

(52) U.S. Cl.
CPC ..... *E21B 4/02* (2013.01); *E21B 4/006* (2013.01); *E21B 10/60* (2013.01); *E21B 12/04* (2013.01)

(58) Field of Classification Search
CPC ..... E21B 47/005; E21B 33/13; E21B 33/14; E21B 47/047; E21B 47/06; E21B 33/12
See application file for complete search history.

(56) References Cited

U.S. PATENT DOCUMENTS

| | | | | |
|---|---|---|---|---|
| 9,574,417 | B2 | 2/2017 | Laird et al. | |
| 10,072,472 | B2 | 9/2018 | Jensen | |
| 11,125,033 | B2 | 9/2021 | Edvardsen | |
| 2006/0016744 | A1* | 1/2006 | Miner | E21B 43/128 210/488 |
| 2007/0278007 | A1 | 12/2007 | Krueger et al. | |
| 2008/0029303 | A1 | 2/2008 | Codazzi et al. | |
| 2011/0079391 | A1 | 4/2011 | Bedouet et al. | |
| 2011/0203848 | A1* | 8/2011 | Krueger | E21B 21/08 175/215 |
| 2014/0360724 | A1* | 12/2014 | Laird | E21B 31/002 166/99 |
| 2016/0040495 | A1 | 2/2016 | Mahajan et al. | |
| 2016/0168916 | A1 | 6/2016 | Lakic | |
| 2018/0163729 | A1 | 6/2018 | Xiao et al. | |
| 2020/0040685 | A1* | 2/2020 | Winkler | E21B 17/203 |
| 2021/0040807 | A1 | 2/2021 | Krüger et al. | |

(Continued)

OTHER PUBLICATIONS

International Search Report and Written Opinion for International Patent Application No. PCT/US2025/011374 dated Sep. 11, 2025. PDF file. 9 pages.

*Primary Examiner* — Caroline N Butcher
(74) *Attorney, Agent, or Firm* — John W. Wustenberg; C. Tumey Law Group, PLLC

(57) ABSTRACT

In the drilling of oil and gas wells, some fluid isolation valves may be stuck in a closed position and may need to be milled out. Provided are methods and systems to dissipate heat and remove cuttings and shavings generated during milling of these fluid isolation barrier. The methods may include conveying a milling tool into a borehole, wherein the milling tool comprises a motor, a gear box coupled to the motor; a pump coupled to the gear box, and a mill bit coupled to the pump, milling a fluid isolation barrier positioned in the borehole using the milling tool, wherein heat is generated at the mill bit and by the motor during the milling of the fluid isolation barrier, and removing at least a portion of the heat by pumping fluid past the motor and the mill bit using the pump.

17 Claims, 4 Drawing Sheets

(56) References Cited

U.S. PATENT DOCUMENTS

| | | | | |
|---|---|---|---|---|
| 2021/0233679 | A1* | 7/2021 | Dinkins | H01B 7/228 |
| 2021/0301616 | A1* | 9/2021 | Hallundbæk | E21B 10/26 |
| 2022/0220827 | A1* | 7/2022 | Haugland | B01D 29/6407 |
| 2022/0275708 | A1 | 9/2022 | Borg | |
| 2022/0298876 | A1 | 9/2022 | Puerta | |

* cited by examiner

MOTOR COOLING AND DEBRIS MANAGEMENT DURING MILLING

BACKGROUND

In the drilling of oil and gas wells, a wellbore is formed using a drill bit at the lower end of a drill string. The drill bit is rotated while force is applied through the drill string and against the rock face of the formation being drilled. After drilling to a predetermined depth, the drill string and bit are removed, and the wellbore is lined with a string of casing. An annular area is thus formed between the string of casing and the formation penetrated by the wellbore. A cementing operation is typically conducted to displace drilling fluid and fill part or all of the hollow-cylindrical annular area between the casing and the borehole wall with cement. The combination of cement and casing strengthens the wellbore and facilitates zonal fluid isolation of certain sections of a hydrocarbon-producing formation (or "pay zones") behind the casing. The process of drilling and then cementing progressively smaller strings of casing is repeated several times until the well has reached total depth. In some instances, the final string of casing is also a liner. The final string of casing, referred to as a production casing, is also typically cemented into place.

Fluid isolation valves are used within the completion string to prevent formation damage and minimize workover costs. For example, fluid isolation valves are used to isolate the formation from the upper completion during up-hole operations throughout the life of the well. Further, fluid isolation valves need to be opened to gain access to certain sections of the hydrocarbon-producing formation. However, some fluid isolation valves may be stuck in the closed position and may need to be milled out in this case.

BRIEF DESCRIPTION OF THE DRAWINGS

These drawings illustrate certain aspects of some examples of the present disclosure and should not be used to limit or define the disclosure.

DETAILED DESCRIPTION

Figure 1:
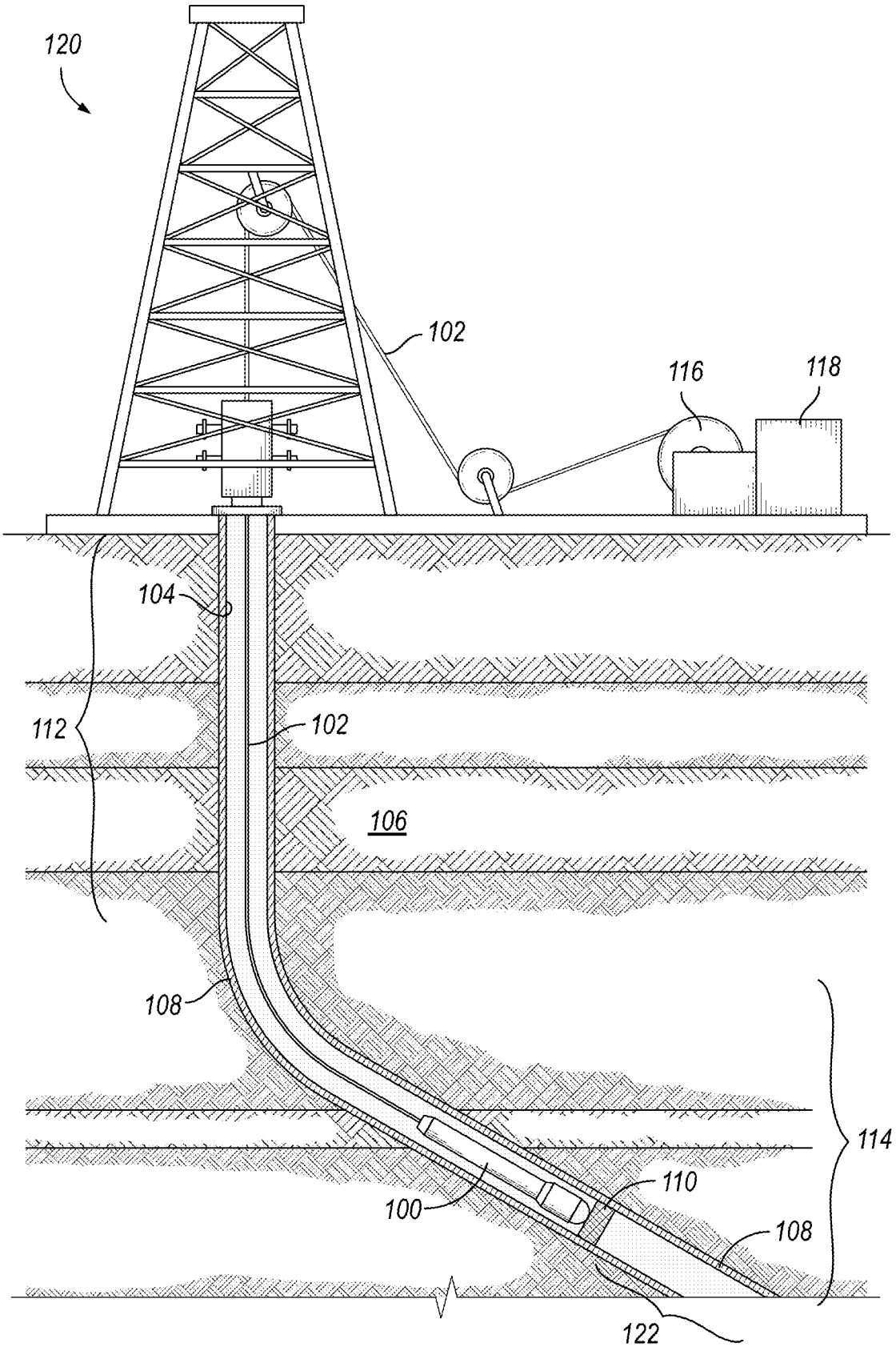
FIG. 1 illustrates an operating environment for a system used for milling a fluid isolation barrier.

The present disclosure relates to the field of well operations, and more specifically to methods and systems to dissipate heat and remove cuttings and shavings generated during milling of a fluid isolation barrier. The fluid isolation barrier may be defined as any barrier controlling the flow of formation fluid or treatment fluid into the casing including a valve or a plug such as a frac plug, a bridge plug, or a non-sealing plug, for example. The fluid isolation barrier may also be defined as any deposit preventing at least partial flow through the casing such as organic scale, inorganic scale, or any deposit accumulated during the production of the reservoir fluid. Alternatively, or additionally, the deposit may come from any human-made treatment fluid such as a fracturing fluid treatment, for example. The systems may include a milling tool comprising power electronics, a motor coupled to the power electronics, a gear box coupled to the motor, a compensation chamber coupled to the gear box, a pump coupled to the compensation chamber through a flexible joint, and a mill bit coupled to the pump through a flexible joint. Optionally, the systems may include power electronics, a motor coupled to the power electronics, a gear box coupled to the motor, a compensation chamber coupled to the gear box, a pump coupled to the gear box through a flexible joint, a second gear box coupled to the pump through a second flexible joint, and a mill bit coupled to the second gear box through a second compensation chamber and a flexible joint. Further, the pump may be configured to generate flow past the motor to at least partially remove the heat generated by the motor, and also to generate flow past the mill bit to at least partially remove the generated heat, cuttings, and shaving. The pump may be any pump capable of generating fluid flow including progressive cavity pump, centrifugal pump, or any combination thereof, for example.

The centrifugal pump may connect the motor to the mill bit. The centrifugal pump may be designed to act as a pump moving fluid past the mill bit, dissipating heat, and removing cuttings and shavings generated during milling of the fluid isolation barrier. The centrifugal pump may be a multistage centrifugal pump. The centrifugal pump may be housed inside a housing, for example. The centrifugal pump is designed to generate flow with a clearance between the centrifugal pump and the housing such that there is enough space for cuttings and shavings to flow through in case there is no screen to prevent any solid from entering housing or the screen is broken. The clearance may be from about 0.005 inch to about 0.2 inch, or from about 0.02 inch to about 0.08 inch, for example. In embodiments, the systems may include a milling tool comprising a motor, a gear box coupled to the motor, a centrifugal pump coupled to the gear box, and a mill bit coupled to the centrifugal pump. In some embodiments, a second gear box may be coupled between the centrifugal pump and the mill bit. In some embodiments, the centrifugal pump may be added to another pump. In embodiments, the centrifugal pump may have 1 to 20 stages, or from 2 to 8 stages, for example. In some embodiments, the centrifugal pump may produce flow rates from about 1 gallon per minute to about 15 gallons per minute, or from about 2 gallons per minute to about 8 gallons per minute. In embodiments, the centrifugal pump may work at downhole pressures ranging from about 100 psi to about 30,000 psi, or from about 5,000 psi to about 25,000 psi, for example. In embodiments, the centrifugal pump may work at downhole temperatures ranging from about 35 F (−4° C.) to about 350 F (177° C.), or from about 150 F (66° C.) to about 300 F (149° C.), for example. The centrifugal pump may be able to handle fluid with viscosity ranging from about 1 cP to about 1,000 cP, or from about 1 cP to about 10 cP, for example.

The progressive cavity pump may be any positive displacement pump capable of generating flow past the motor to at least partially remove the heat generated by the motor, and also generating flow past the mill bit to at least partially remove the generated heat, cuttings, and shaving. The progressive cavity pump may generate flow using any design of sealed cavities and any number of adjacent cavities per stage. The progressive cavity pump may have from one to 10 stages, or from 2 to 8 stages, for example. Further, the progressive cavity pump may have a single lobe design or a multi lobe designs (1:1, 2:1, 3:2, 4:3, 5:4 up to 6:5 lobe designs, for example). The progressive cavity pump may have clearances with its housing ranging from about 0.002 inch to about 0.05 inch, or from about 0.005 inch to about 0.02 inch, for example. In some embodiments, the progressive cavity pump may produce flow rates from about 1 gallon per minute to about 15 gallons per minute, or from about 2 gallons per minute to about 8 gallons per minute. In embodiments, the progressive cavity pump may work at downhole pressures ranging from about 100 psi to about 30,000 psi, or from about 5,000 psi to about 25,000 psi, for example. In embodiments, the progressive cavity pump may work at downhole temperatures ranging from about 35 F (−4° C.) to about 350 F (177° C.), or from about 150 F (66° C.) to about 300 F (149° C.), for example. The progressive cavity pump may be able to handle fluid with a viscosity ranging from 1 about cP to about 1,000 cP, or from about 1 cP to about 10 cP, for example.

FIG. 1 illustrates an operating environment for system 100 for milling a fluid isolation barrier according to embodiments of the present disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, FIG. 1 shows system 100 being conveyed by a wireline 102 into a wellbore 104 in a formation 106. Wellbore 104 includes a casing 108 and a fluid isolation barrier 110. Wellbore 104 may have a vertical section 112 and a deviated section 114. System 100 may be conveyed by wireline 102 in vertical section 112 or in deviated section 114 to mill fluid isolation barrier 110. Wireline 102 is operatively connected to a winch 116 and a control unit 118. A derrick 120 supports wireline 102.

Casing 108 may extend along a full length of wellbore 104 as shown in FIG. 1; however, in other embodiments, wellbore 104 may be an open hole wellbore that is uncased, or wellbore 104 may include both cased portions and open hole portions. Casing 108 within wellbore 104 may also include various types of casing, including surface casing, intermediate casing, conductor casing, production casing, production liner, and the like. In some embodiments, as the depth of wellbore 104 increases, the diameter of casing 108 may decrease. In at least some embodiments, casing 108 may provide structural integrity to wellbore 104, isolate wellbore 104 against fluids within formation 106, or provide other aspects or features. In some applications, after casing 108 is cemented or otherwise installed within wellbore 104, a portion of casing 108 may be perforated or removed to facilitate or stimulate production in the corresponding portion or zone of the formation 106. In FIG. 1 for instance, some perforations (not shown) may be made in casing 108 and may extend radially outward into formation 106. Following the formation of the perforations, stimulation fluid may be pumped into wellbore 104 and through the perforations. The stimulation fluid may be pumped in at a sufficiently high pressure to cause formation 106 to crack or fracture, thereby opening up fluid passageways to stimulate production of hydrocarbons, water, or other fluids in that particular zone within formation 106. In some embodiments, proppant or other materials may be included in the fluid to assist in fracturing formation 106 or to hold open the formed fractures.

Fluid isolation barrier 110 may be set within wellbore 104, and in some embodiments may facilitate the use of the stimulation fluid in fracturing formation 106. In this particular embodiment, fluid isolation barrier 110 may hydraulically seal a portion of wellbore 104 below fluid isolation barrier 110 (i.e., section 122 in FIG. 1) from a portion of wellbore 104 above fluid isolation barrier 110. As stimulation fluid is then pumped into wellbore 104, fluid isolation barrier 110 may restrict and potentially prevent the fluid from flowing downhole into section 122 beyond fluid isolation barrier 110 and deeper into wellbore 104. The stimulation fluid may thereby be forced into formation 106 through the perforations. Fluid isolation barrier 110 may include a frac plug, a bridge plug, a non-sealing plug, an organic scale, an inorganic scale, any deposit accumulated during the production of the reservoir fluid, and/or any deposit coming from any human-made treatment fluid, for example. A bridge plug may also be used to seal or isolate different portions of wellbore 104. A frac plug may be a particular type of bridge plug for use in fracturing formation 106, but bridge plugs may be used in myriad of other applications. For instance, bridge plugs may also be used in wellbore abandonment, acidizing, cementing, selective single-zone operations, treatment, testing, repair/remedial, or other applications, or any combination of the foregoing. In other embodiments, fluid isolation barrier 110 may be a non-sealing plug (e.g., an anchor).

Figure 2:
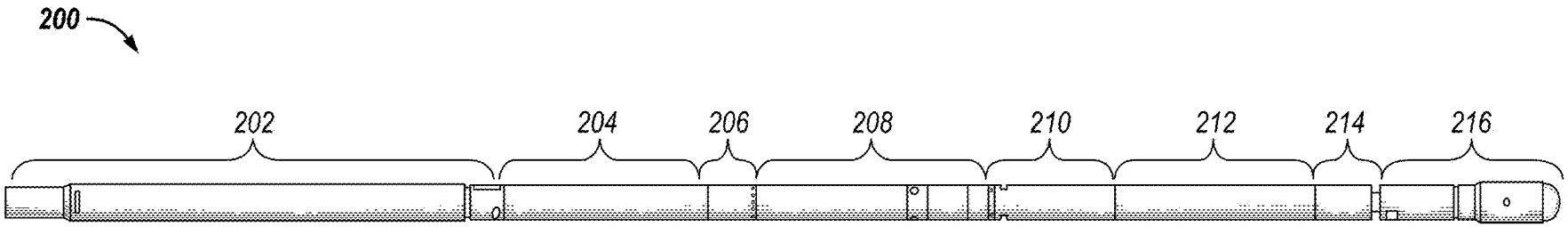
FIG. 2 illustrates a system for milling a fluid isolation barrier according to embodiments of the present disclosure.

FIG. 2 illustrates the system 200 according to embodiments of the present disclosure configured to grind, mill, degrade, or break-up fluid isolation barrier 110 (referring to FIG. 1). System 200 includes power electronics 202, a motor 204 coupled to power electronics 202, a gear box 206 coupled to motor 204, a compensation chamber 208 coupled to gear box 206, a pump 212 coupled to compensation chamber 208 through a flexible joint 210, and a mill bit 216 coupled to pump 212 through a flexible joint 214. It should be noted that pump 212 may be any pump capable of generating flow around motor 204 and mill bit 216 including centrifugal pump or progressive cavity pump, for example.

Power electronics 202 may be any power electronics capable of controlling motor 204, gear box 206, second gear box 302, compensation chamber 208, pump 212, mill bit 216, and any other equipment needed in system 200. Motor 204 may be any motor that may be placed downhole capable of generating rotations of mill bit 216 through gear box 206. Gear box 206 may be any gear arranged to reduce the rotational output from motor 204 to mill bit 216 through compensation chamber 208. Compensation chamber 208 may be any compensation chamber capable of handling high pressures and high temperatures typically found downhole as well as any pressure surge and helping in controlling flow rate through pump 212. Flexible joints 210, 214 may be any flexible joint capable of connecting at least two components including pin joint, cardan joint, flexible shaft, gear type joint, or any combination thereof, for example.

Pump 212 may be designed to act as a pump moving fluid past mill bit 216, dissipating heat, and removing cuttings and shavings generated during milling of fluid isolation barrier 110. Pump 212 also pumps fluid past motor 204 to dissipate at least partially the heat generated by motor 204. Pump 212 may be any pump capable of generating fluid flow including progressive cavity pump, centrifugal pump, or any combination thereof, for example. The progressive cavity pump, centrifugal pump, or any combination thereof may be housed inside a housing, for example. The centrifugal pump is designed to generate flow as it rotates with a clearance between the impeller and the housing such that there is enough space for cuttings and shavings to flow through in case there is no screen to prevent any solid from entering housing or the screen is broken. The progressive cavity pump may be any positive displacement pump capable of generating flow past motor 204 to at least partially remove the heat generated by motor 204, and generating flow past mill bit 216 to at least partially remove the generated heat, cuttings, and shaving. The progressive cavity pump may generate flow using any design of sealed cavities and any number of adjacent cavities per stage including from 1 to 10 stages as described above, for example.

Mill bit 216 may include a bit body having one or more blades, knives, or other cutting structure thereon. These blades or other cutting structures may further include or be coupled to cutting elements configured to grind, mill, degrade, or break-up fluid isolation barrier 110 (referring to FIG. 1). The blades and the cutting elements may have any suitable configuration. For instance, there may be multiple blades circumferentially spaced around the bit body of mill bit 216. Any number of blades may be provided. For instance, there may be between 1 and 20 blades in some embodiments. More particularly, there may be 1, 2, 4, 6, 8, 10. 12, 15, 18, 20 blades, or any value therebetween. In other embodiments, there may be more than 20 blades or there may be no blades and other cutting structures (e.g., roller cones, etc.) may be used. The blades may each be the same, or different, and there may be equal or unequal spacing between the blades. Mill bit 216 may be operated using information handling system (not shown) that sends commands through power electronics 202 to motor 204 that engages gear box 206 that reduces the rotational output from motor 204 to mill bit 216 through compensation chamber, for example.

Figure 3:
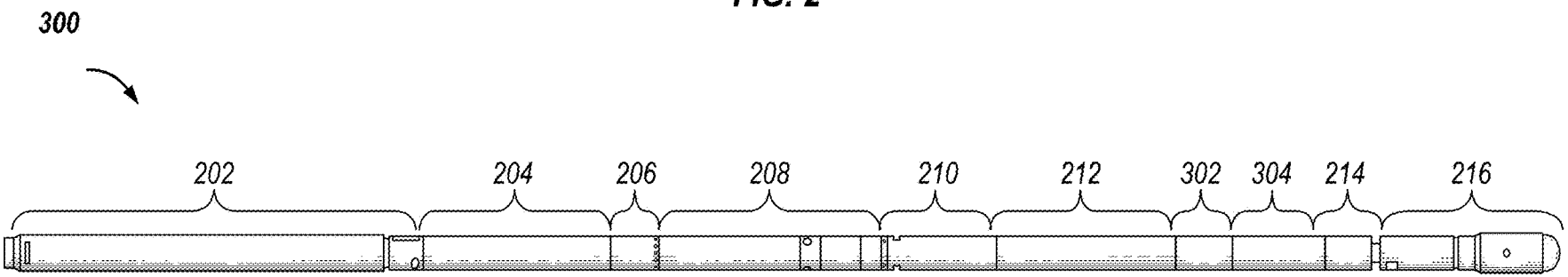
FIG. 3 illustrates a system for milling a fluid isolation barrier according to embodiments of the present disclosure.

FIG. 3 illustrates system 300 according to embodiments of the present disclosure configured to grind, mill, degrade, or break-up fluid isolation barrier 110 (referring to FIG. 1) if a change of gear ratio between pump 212 and mill bit 216 is further needed. System 300 includes power electronics 202, motor 204 coupled to power electronics 202, gear box 206 coupled to motor 204, compensation chamber 208 coupled to gear box 206, compensation chamber 208 coupled to pump 212 through a flexible joint 210, a second gear box 302 coupled to pump 212, a second compensation chamber 304 coupled to second gear box 302, and mill bit 216 connected to second compensation chamber 304 through a flexible joint 214.

Power electronics 202 may be any power electronics capable of controlling motor 204, gear box 206, compensation chamber 208, pump 212, second gear box 302, second compensation chamber 304, mill bit 216, and any other equipment needed on system 100, 200, or 300. Motor 204 may be any motor that may be placed downhole. Motor 204 may be any motor that may be placed downhole capable of generating rotation of mill bit 216 through gear box 206. Gear box 206 may be any gear arranged to reduce the rotational output from motor 204 to second gear box 302 to mill bit 216 through compensation chamber 208. Gear box 206 and second gear box 302 may be any gear arranged to reduce the rotational output from motor 204 to mill bit 216 through compensation chamber 208 and second compensation chamber 304. Compensation chamber 208 and second compensation chamber 304 may be any compensation chamber capable of handling high pressures and high temperatures typically found downhole as well as any pressure surge and helping in controlling flow rate through pump 212. Flexible joints 210, 214 may be any flexible joint capable of connecting at least two components including pin joint, cardan joint, flexible shaft, gear type joint, or any combination thereof, for example.

Pump 212 is added to remove at least partially the heat generated by motor 204, and also to generate flow past mill bit 216 to at least partially remove the generated heat, cuttings, and shaving. Pump 212 may be any pump capable of generating fluid flow including progressive cavity pump, centrifugal pump, or any combination thereof, for example. Pump 212 may connect motor 204 to mill bit 216. Pump 212 may be designed to act as a pump moving fluid past mill bit 216, dissipating heat, and removing cuttings and shavings generated during milling of fluid isolation barrier 110. Pump 212 may be placed in between gear box 206 and second gear box 302 as illustrated in FIG. 3 or alternatively, after second gear box 302 or before gear box 206.

Mill bit 216 may be operated using information handling system (not shown) that sends commands through power electronics 202 to motor 204 that engages gear box 206 that reduces the rotational output from motor 204 to mill bit 216 through compensation chamber 208 and second gear box 302 through second compensation chamber 304. Mill bit 216 may include a bit body having one or more blades, knives, or other cutting structure thereon. These blades or other cutting structures may further include or be coupled to cutting elements configured to grind, mill, degrade, or break-up fluid isolation barrier 110 (referring to FIG. 1). The blades and the cutting elements may have any suitable configuration. For instance, there may be multiple blades circumferentially spaced around the bit body of mill bit 216. Any number of blades may be provided. For instance, there may be between 1 and 20 blades in some embodiments. More particularly, there may be 1, 2, 4, 6, 8, 10. 12, 15, 18, 20 blades, or any value therebetween. In other embodiments, there may be more than 20 blades or there may be no blades and other cutting structures (e.g., roller cones, etc.) may be used. The blades may each be the same, or different, and there may be equal or unequal spacing between the blades.

Figure 4:
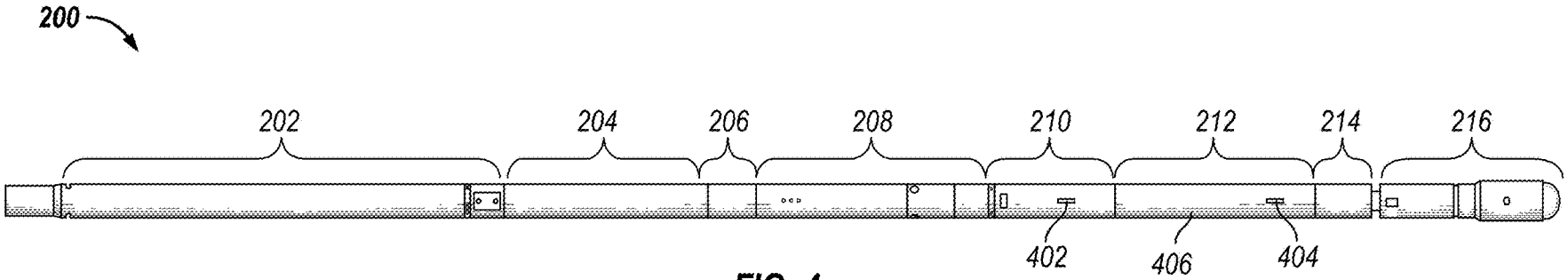
FIG. 4 illustrates a system with a pump comprising a housing having an inlet vent and an outlet vent used to mill a fluid isolation barrier according to embodiments of the present disclosure.

FIG. 4 illustrates system 200 with pump inlet 402 on flexible joint 210 and pump outlet 404 on pump housing 406 according to embodiments of the present disclosure. Pump inlet 402 may be defined as any hole allowing fluid communication between the fluid present in between casing 108 and system 200 and the inside of pump 212 including one or more holes with one or more screen to prevent drilling solids and milling debris from entering pump 212. Pump outlet 404 may be defined as any hole allowing fluid communication between the fluid present in between casing 108 and system 200 and the inside of pump 212 including one or more holes with one or more screen to prevent drilling solids and milling debris from entering pump 212. Pump inlet 402 and pump outlet 404 may have the same design or different design as will be described below.

System 200 may be configured to grind, mill, degrade, or break-up fluid isolation barrier 110 (e.g., referring to FIG. 1). Flexible joint 210 may comprise one pump inlet 402 and pump 212 may comprise pump housing 406 with one pump outlet 404 arranged on the same side of pump housing 406 or they may be arranged radially. Alternatively, pump 212 may comprise pump housing 406 with one pump inlet 402 and one pump outlet 404 arranged on the same side of pump housing 406 or they may be arranged radially. Further, pump 212 may comprise two or more pump inlets 402 and/or two or more pump outlets 404 arranged radially on pump housing 406, or any combination thereof. In embodiments, pump inlet 402 and pump outlet 404 may be reversed before pumping or after a number of pumping cycles by reversing the pumping flow through motor 204.

Figure 5:
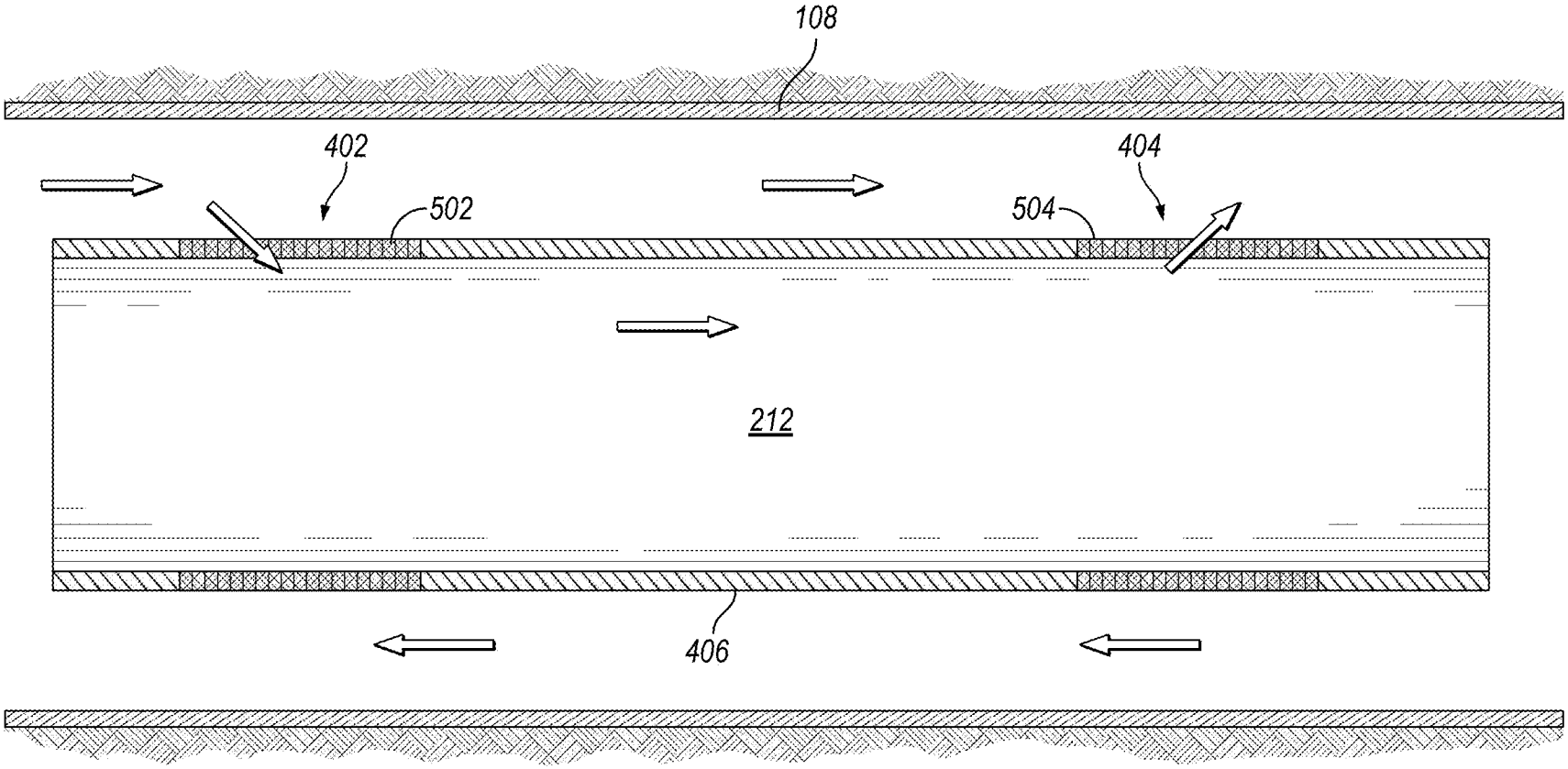
FIG. 5 illustrates a pump comprising a housing having an inlet vent and an outlet vent according to embodiments of the present disclosure.

System 200 in FIG. 4 includes power electronics 202, motor 204 coupled to power electronics 202, gear box 206 coupled to motor 204, compensation chamber 208 coupled to gear box 206, pump 212 connected through flexible joint 210 to compensation chamber 208 and to mill bit 216 through flexible joint 214. The design of pump inlet 402 located in flexible joint 214 and pump outlet 404 located on pump housing 406 of pump 212 may play an important role in generating fluid flow past motor 204 to at least partially remove the heat generated by motor 204, and in generating fluid flow past mill bit 216 to at least partially remove the generated heat, cuttings, and shaving. Pump inlet 402 in flexible joint 214 and pump outlet 404 on pump housing 406 allow fluid around system 200 to flow in and out of pump 212. As fluid around system 200 flows through pump inlet 402 and pump outlet 404 of pump housing 406, the generated flow removes heat generated by motor 204 and generates flow past mill bit 216 to at least partially remove the generated heat, cuttings, and shaving. The generated flow through pump inlet 402 into pump 212 and out through pump outlet 404 may range from about 1 gallon per minute to about 15 gallons per minute, or from about 3 gallons per minute to about 8 gallons per minute, for example. It should be noted that pump inlet 402 may be located in pump 212 as illustrated in FIG. 5 described below. Further, pump inlet 402 and pump outlet 404 may be reversed as compared to their respective position described in FIG. 5 below.

Figure 6:
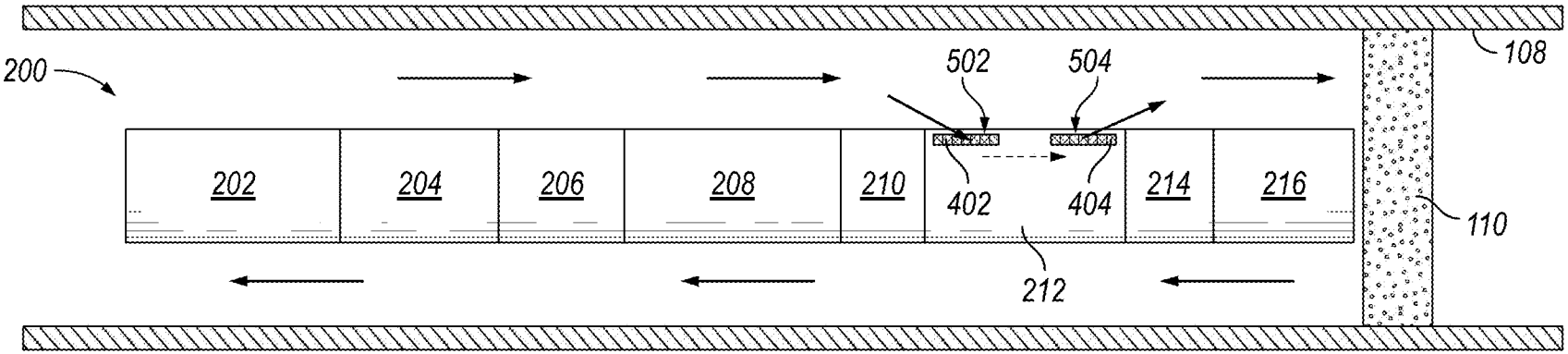
FIG. 6 illustrates the system with a pump housing having an inlet vent and an outlet vent located on the same side according to embodiments of the present disclosure.

FIG. 5 illustrates pump 212 with pump inlet 402 and pump outlet 404 on pump housing 406 inside casing 108 according to embodiments of the present disclosure. Pump inlet 402 and pump outlet 404 may be covered by a screen, screen 502 and screen 504, respectively, to prevent solids such as drilling solids and milling debris from entering pump 212. The screen may be of any mesh size including from about 0.1 inch (2.54 mm) to about 1 inch (2.54 cm) wide, from about 0.25 inch (6.35 mm) to about 0.75 inch (1.9 cm) wide, or about 0.5 inch wide (1.27 cm), for example. The mesh may be from about 0.5 inch (1.27 cm) to about 3 inch (7.62 cm) long, or about 1 inch to about 2.5 inch (6.35 cm) long, or about 2 inch (5.08 cm) long, for example. The hole of the mesh may be of any shape including rounded, oval, rectangular, diamond-shaped, triangular, square, star-shaped, keyhole, or hexagonal, for example. FIG. 5 illustrates pump 212 with pump inlet 402 and pump outlet 404 on the same side. Pump inlet 402 may be bigger than pump outlet 404 to accelerate the flow of fluid inside pump 212. Alternatively, pump inlet 402 may be smaller than pump outlet 404. The size of pump inlet 402 and pump outlet 404 may be defined by the actual pump inlet 402 and pump outlet 404 or by their respective screens, 502 and 504. Further, the direction of the flow in and out of pump 212 may be oriented by the shape of pump inlet 402 and pump outlet 404 and/or their respective screen, 502 and/or 504. The shape of pump inlet 402 and pump outlet 404 and/or their respective screen, 502 and/or 504, may be directed uphole (from mill bit 216 to motor 204) or directed downhole (from motor 204 to mill bit 216). They may be directed with a shape of pump inlet 402 and pump outlet 404 and/or their respective screen, 502 and/or 504, having an angle of 45° uphole or downhole as compared to the axis between motor 204 and mill bit 216, for example. Alternatively, if no direction is given, an angle of 90° as compared to the axis between motor 204 and mill bit 216 may be preferred, for example. Pump inlet 402 and/or its screen, 502, may have a 45° angle upstream as compared to the axis between motor 204 to mill bit 216 while pump outlet 404 and/or its screen, 504, may have a 90° angle as compared to the axis between motor 204 and mill bit 216, for example, or vice versa. Pump inlet 402 and/or its screen 502 may have a 45° angle upstream as compared to the axis between motor 204 to mill bit 216 while pump outlet 404 and/or its screen 504 may have a 135° angle as compared to the axis between motor 204 and mill bit 216, for example, or vice versa FIG. 6 illustrates system 200 with pump inlet 402 and pump outlet 404 on the same side of pump housing 406 of pump 212 inside casing 108 according to embodiments of the present disclosure. System 200 may be configured to grind, mill, degrade, or break-up fluid isolation barrier 110 (e.g., referring to FIG. 1) with fluid flow represented with arrows flowing between system 200 and casing 108. Upon the action of pump 212, the fluid present in between casing 108 and system 200 is sucked into pump 212 through pump inlet 402 and pump out through pump outlet 404 on one side of system 200 so that a fluid flow is created and maintained from uphole to downhole or from motor 204 upstream to mill bit 216 downstream on the same side of system 200 as pump inlet 402 and pump outlet 404 are located, and the fluid flow is pushed uphole from mill bit 216 to motor 204 on the other side of pump inlet 402 and pump outlet 404 are located as illustrated with the arrows in FIG. 6. The generated fluid flow passes by motor 204 to at least partially remove the heat generated by motor 204, and passes by mill bit 216 to at least partially remove the generated heat, cuttings, and shaving from milling fluid isolation barrier 110.

Figure 7:
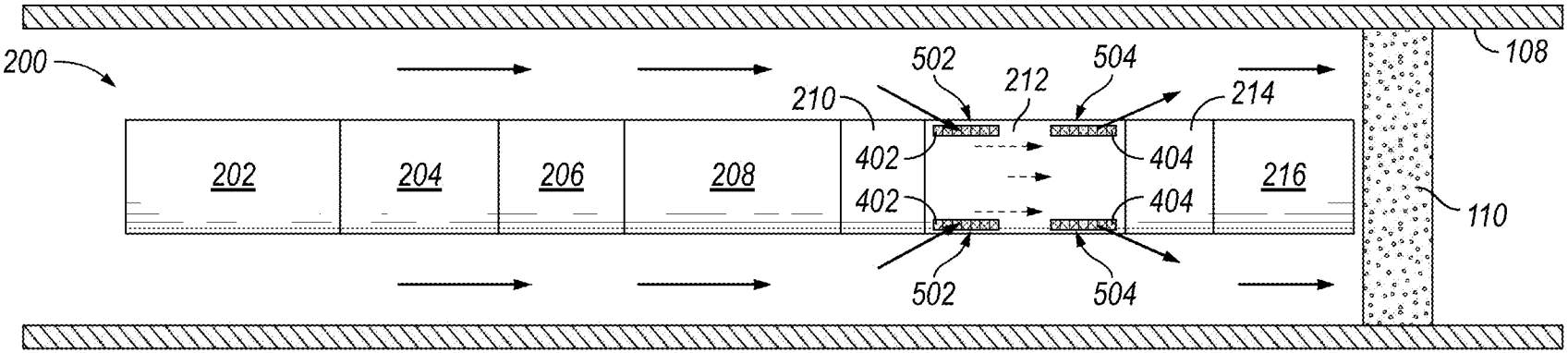
FIG. 7 illustrates the system with a pump housing having two pump inlets and two pump outlets according to embodiments of the present disclosure.

FIG. 7 illustrates an alternative embodiment of system 200 wherein two pump inlets 406 and two pump outlets 408 are located on opposite sides of pump housing 406 of pump 212 inside casing 108 according to embodiments of the present disclosure. System 200 may be configured to grind, mill, degrade, or break-up fluid isolation barrier 110 (e.g., referring to FIG. 1) with fluid flow represented with arrows flowing between system 200 and casing 108. Uphole fluid is sucked from motor 204 to pump inlet 402 of pump housing 406 of pump 212 and pump out through pump outlet 404 downhole towards mill bit 216 on each side of system 200 towards fluid isolation barrier 110 as illustrated by the arrows in FIG. 7. The generated fluid flow passes by motor 204 to at least partially remove the heat generated by motor 204, and passes by mill bit 216 to at least partially remove the generated heat, cuttings, and shaving from milling fluid isolation barrier 110. The regime of the fluid flow around motor 204 and around mill bit 216 may depend upon the pumping flow rate generated by pump 212 including laminar flow or turbulent flow.

In embodiments, the two pump inlets 402 may be spaced apart by from about 5° to about 355° and any angle in-between including from about 15° to about 345°, from about 30° to about 330°, from about 45° to about 300°, from about 60° to about 270°, from about 90° to about 245°, from about 120° to about 210°, from about 150° to about 180°, for example.

In embodiments, the two pump outlets 404 may be spaced apart by from about 5° to about 355° and any angle in-between including from about 15° to about 345°, from about 30° to about 330°, from about 45° to about 300°, from about 60° to about 270°, from about 90° to about 245°, from about 120° to about 210°, from about 150° to about 180°, for example.

In alternative embodiments, pump 212 may comprise three pump inlets 402 and two pump outlets 404 on pump housing 406 or vice versa, two pump inlets 402 and three pump outlets 404, for example. In embodiments, pump 212 may comprise three pump inlets 402 and three pump outlets 404. In embodiments, pump 212 may comprise four or more pump inlets 402 and/or three or more pump outlets 404. In embodiments, pump 212 may comprise three or more pump inlets 402 and four or more pump outlets 404. In embodiments, pump 212 may comprise one pump inlet 402 and two or more pump outlets 404 or vice versa.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. The systems and methods may comprise any of the various features disclosed herein, comprising one or more of the following statements.

Statement 1. A milling tool comprising: a motor; a gear box coupled to the motor; a pump coupled to the gear box; a mill bit coupled to the pump; and wherein the pump generates flow past the motor and the mill bit to at least partially remove generated heat Statement 2. The milling tool of statement 1, further comprising a second gear box coupled to the pump, wherein the pump is positioned between the gear box and the second gear box Statement 3. The milling tool of statement 1 or statement 2, wherein the pump comprises a progressive cavity pump, a centrifugal pump, or any combination thereof.

Statement 4. The milling tool of any one of statements 1-3, wherein the pump comprises a housing having a pump inlet and a pump outlet on one side of the housing.

Statement 5. The milling tool of any one of statements 1-4, wherein the pump comprises a housing having a pump inlet and a pump outlet arranged radially on the housing.

Statement 6. The milling tool of any one of statements 1-5, wherein the motor turns the gear box which turns the pump which turns the mill bit.

Statement 7. The milling tool of any one of statements 1-6, wherein the pump comprises a housing having a pump inlet and a pump outlet designed to orient flow towards the motor, and wherein the pump outlet is smaller than the pump inlet.

Statement 8. The milling tool of any one of statements 1-7, wherein the pump is designed to orient one flow from the motor to the mill bit on one side of the milling tool and another flow from the mill bit to the motor on another side of the milling tool.

Statement 9. The milling tool of any one of statements 1-8, wherein the pump comprises a housing having a pump inlet and a pump outlet with one or more screens positioned with respect to at least the pump inlet to prevent cuttings and shavings from entering the housing.

Statement 10. The milling tool of any one of statements 1-9, wherein the screens have a mesh size from about 0.1 inch to about 1 inch wide and from about 0.5 inch to about 2 inches long.

Statement 11. A method comprising: conveying a milling tool into a borehole, wherein the milling tool comprises a motor, a gear box coupled to the motor; a pump coupled to the gear box, and a mill bit coupled to the pump; milling a fluid isolation barrier positioned in the borehole using the milling tool, wherein heat is generated at the mill bit and by the motor during the milling of the fluid isolation barrier; and removing at least a portion of the heat by pumping fluid past the motor and the mill bit using the pump.

Statement 12. The method of statement 11, wherein the milling tool further comprises a second gear box coupled to the pump, wherein the pump is positioned between the gear box and the second gear box.

Statement 13. The method of statement 11 or statement 12, wherein the pump comprises a progressive cavity pump, a centrifugal pump, or any combination thereof.

Statement 14. The method of any one of statements 11-13, wherein the pump comprises a housing having a pump inlet and a pump outlet on one side of the housing.

Statement 15. The method of any one of statements 11-14, wherein the pump comprises a housing having a pump inlet and a pump outlet arranged radially on the housing.

Statement 16. The method of any one of statements 11-15, wherein the pump is designed to orient a flow towards the mill bit.

Statement 17. The method of any one of statements 11-16, wherein the pump is designed to orient a flow towards the motor.

Statement 18. The method of any one of statements 11-17, wherein the pump is designed to orient one flow from the motor to the mill bit on one side of the milling tool and another flow from the mill bit to the motor on another side of the milling tool.

Statement 19. The method of any one of statements 11-18, wherein the pump comprises a housing having a pump inlet and a pump outlet with one or more screens positioned with respect to at least the pump inlet to prevent cutting and shaving from entering the housing.

Statement 20. The method of any one of statements 11-19, wherein the screens have a mesh size from about 0.1 inch to about 1 inch wide and from about 0.5 inch to about 2 inches long.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A milling tool comprising:

a motor;

a gear box coupled to the motor;

a pump coupled to the gear box;

a mill bit coupled to the pump;

wherein the pump generates flow past the motor and the mill bit to at least partially remove generated heat; and wherein the pump comprises a housing having a pump inlet and a pump outlet designed to orient flow towards the motor, and wherein the pump outlet is smaller than the pump inlet.

2. The milling tool of claim 1, further comprising a second gear box coupled to the pump, wherein the pump is positioned between the gear box and the second gear box.

3. The milling tool of claim 1, wherein the pump comprises a progressive cavity pump, a centrifugal pump, or any combination thereof.

4. The milling tool of claim 1, wherein the pump comprises a housing having the pump inlet and the pump outlet on one side of the housing.

5. The milling tool of claim 1, wherein the pump comprises a housing having the pump inlet and the pump outlet arranged radially on the housing.

6. The milling tool of claim 1, wherein the motor turns the gear box which turns the pump which turns the mill bit.

7. The milling tool of claim 1, wherein the pump comprises a housing having the pump inlet and the pump outlet with one or more screens positioned with respect to at least the pump inlet to prevent cuttings and shavings from entering the housing.

8. The milling tool of claim 7, wherein the screens have a mesh size from about 0.1 inch to about 1 inch wide and from about 0.5 inch to about 2 inches long.

9. A method comprising:

conveying a milling tool into a borehole, wherein the milling tool comprises a motor, a gear box coupled to the motor; a pump coupled to the gear box, and a mill bit coupled to the pump, wherein the pump comprises a housing having a pump inlet and a pump outlet designed to orient flow towards the motor, and wherein the pump outlet is smaller than the pump inlet;

milling a fluid isolation barrier positioned in the borehole using the milling tool, wherein heat is generated at the mill bit and by the motor during the milling of the fluid isolation barrier; and removing at least a portion of the heat by pumping fluid past the motor and the mill bit using the pump.

10. The method of claim 9, wherein the milling tool further comprises a second gear box coupled to the pump, wherein the pump is positioned between the gear box and the second gear box.

11. The method of claim 9, wherein the pump comprises a progressive cavity pump, a centrifugal pump, or any combination thereof.

12. The method of claim 9, wherein the pump comprises a housing having the pump inlet and the pump outlet on one side of the housing.

13. The method of claim 9, wherein the pump comprises a housing having the pump inlet and the pump outlet arranged radially on the housing.

14. The method of claim 9, wherein the pump is designed to orient a flow towards the mill bit.

15. The method of claim 9, wherein the pump is designed to orient a flow towards the motor.

16. The method of claim 9, wherein the pump comprises a housing having a pump inlet and a pump outlet with one or more screens positioned with respect to at least the pump inlet to prevent cutting and shaving from entering the housing.

17. The method of claim 16, wherein the screens have a mesh size from about 0.1 inch to about 1 inch wide and from about 0.5 inch to about 2 inches long.

* * * * *